United States Patent [19]

Sanzenbacher et al.

[11] 4,165,978

[45] Aug. 28, 1979

[54] BRIQUET SHEET BREAKING BY COOLING AND BENDING

[75] Inventors: Charles W. Sanzenbacher; Robert M. Escott, both of Charlotte, N.C.

[73] Assignee: Midrex Corporation, Charlotte, N.C.

[21] Appl. No.: 924,541

[22] Filed: Jul. 14, 1978

[51] Int. Cl.[2] ..... C21B 13/02; C22B 1/14

[52] U.S. Cl. ..... 75/3; 75/34; 75/44 R; 264/111; 264/118; 264/348; 266/137; 266/259

[58] Field of Search ..... 75/3, 4, 5, 33, 34, 75/35, 36, 37, 44 R, 44 S; 264/111, 117, 348, 118; 29/420.5; 266/137, 260, 259; 425/237

[56] References Cited

U.S. PATENT DOCUMENTS

| | | | |
|---|---|---|---|
| 2,287,663 | 6/1942 | Brassert | 75/3 |
| 3,091,012 | 5/1963 | Bell | 75/3 |
| 3,300,815 | 1/1967 | Rohaus et al. | 425/237 |
| 3,497,190 | 2/1970 | Moore | 75/44 R |
| 3,556,500 | 1/1971 | Fritz et al. | 266/137 |
| 3,713,763 | 1/1973 | Harris | 75/44 R |
| 3,986,864 | 10/1976 | Hofmann | 75/3 |
| 4,037,303 | 7/1977 | Rieschel | 264/118 |
| 4,093,455 | 6/1978 | Pietsch | 75/3 |

*Primary Examiner*—L. Dewayne Rutledge
*Assistant Examiner*—Michael L. Lewis
*Attorney, Agent, or Firm*—Ralph H. Dougherty

[57] ABSTRACT

Apparatus for separating a sheet of briquets issuing from a briquetting machine into individual briquets by bending the briquet sheet both longitudinally and transversely to break the connections between adjacent briquets. The apparatus includes a carrying conveyor having arcuate, waveform or sawtooth conveyor slats and a conforming conveyor having conveyor slats with a cross section which mates with that of the carrying conveyor. The conforming conveyor forces the briquet sheet to conform to the slat configuration of the first conveyor and to pass around a pivot means which breaks or separates the sheet into individual briquets.

5 Claims, 8 Drawing Figures

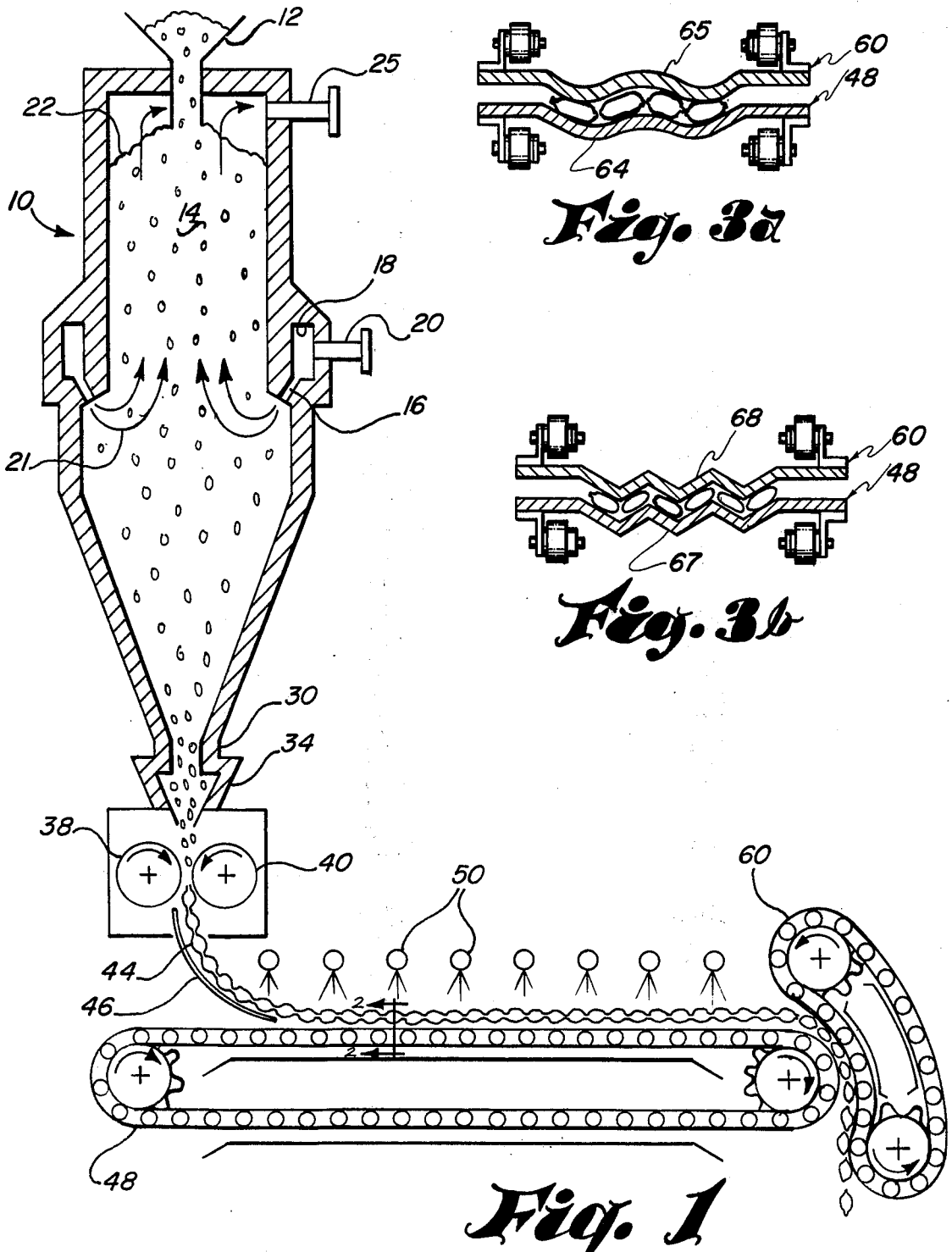
Fig. 1
Fig. 3a
Fig. 3b
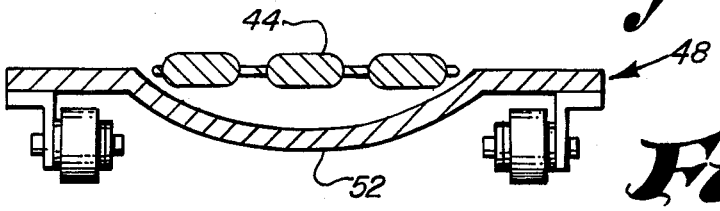
Fig. 2

BRIQUET SHEET BREAKING BY COOLING AND BENDING

BACKGROUND OF THE INVENTION

This invention relates to the agglomeration of fine particulate material into briquets. More particularly it relates to apparatus for forming metallized particulates into briquets which are joined together by a web to form a sheet of connected briquets and breaking the sheet into individual briquets for further processing.

Particulate material is agglomerated by a variety of agglomeration techniques. One such technique is known as briquetting in which particulate solids are compacted between two countercurrently rotating rolls, each having a number of recesses or pockets. Sometimes the pockets on one roll mate with the pockets on another but frequently the pockets on one roll mate with a smooth surface of the other roll. Although in theory each shaped briquet is an entity unto itself and is not connected to any other briquet, in practice a web is formed between adjacent briquets resulting in a continuous briquet strip product issuing from the briquetter rolls. Each briquet is connected in both directions to each succeeding briquet by the web thereby forming a sheet of connected briquets. There must be from one to 10 mm clearance between briquetting rolls, and the web is formed in this region of clearance. Even if the rolls were able to be pressed tightly against one another with no clearance between them, a web would form between briquets as particulate material is not subject to the natural laws of liquid flow. When briquetting rolls begin to wear, the web becomes thicker and more difficult to break than the thinner webs produced by new or freshly ground rolls. The web is more dense and much stronger than the briquets. Breaking tests with metallized iron briquets have shown the connection to be approximately five times as strong as the briquets, and roughly one-half as strong as mild steel plate. When two briquets are broken apart, the connection tears through the briquet, rather than the web. The problem of breaking the briquet sheet into its individual briquets has been a continuing one as is evidenced by U.S. Pat. No. 3,300,815; U.S. Pat. No. 3,593,378; and U.S. Pat. No. 3,986,864.

As a metallized iron briquet sheet leaves the briquetting machine, the hot compacted sheet is relatively plastic and easily bent but difficult to break into individual briquets. Consequently, we have found that it is necessary to cool the briquet sheet to a temperature of 425° C. or lower. At this temperature the physical characteristics of iron are such that it is almost as brittle as it is at ambient temperature. The strength, ductility and elongation properties of iron do not change significantly between room temperature and 425° C. Thus the briquet sheet is easily broken when deformed by an externally applied load. We also found it necessary to bend the cooled briquet sheet at least 10 degress and preferably 15 degrees between adjacent briquets to achieve a break.

OBJECTS OF THE INVENTION

It is the principal object of this invention to provide an apparatus for breaking apart individual briquets which have been produced by a briquetting apparatus in the form of a sheet or strip of connected briquets.

It is also an object to provide a method for producing individual briquets.

SUMMARY OF THE INVENTION

The objects of this invention are achieved by providing apparatus that bends the briquet sheet transversely then bends it longitudinally while still having a curved transverse section and creating high breaking stresses in the webs between the briquets. The application of these forces causes each briquet to separate from adjacent briquets.

BRIEF DESCRIPTION OF THE DRAWINGS

This invention is better understood by referring to the following detailed description and the appended drawings in which:

FIG. 1 is a schematic elevational view of a hot discharge direct reduction furnace, briquetting machine, sheet quench and breaker apparatus.

FIG. 2 is a cross-sectional view of the briquet sheet and conveyor taken along line 2—2 of FIG. 1.

FIG. 3A shows an alternative slat configuration.

FIG. 3B shows another alternative slat configuration.

DETAILED DESCRIPTION

Figure 3:
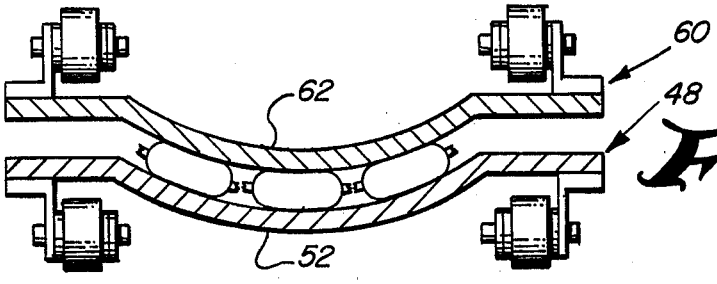
FIG. 3 is a cross-section of the briquet breaker apparatus taken along line 3—3 of FIG. 4.
Figure 4:
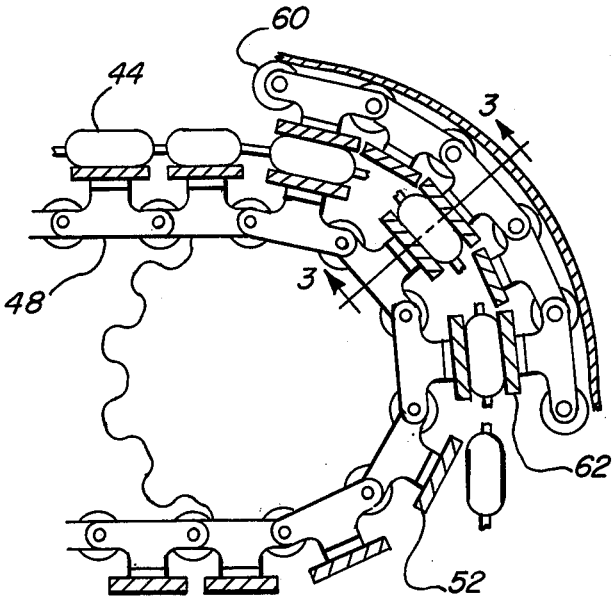
FIG. 4 is an enlarged view of a portion of FIG. 1 showing the relationship of the conveyor in greater detail.

Referring now to FIG. 1, a reduction furnace 10 has a feed hopper 12 which feeds metal oxide pellets, lump, or the like to the interior of the reduction furnace to establish a burden 14 therein. Hot reducing gas is directed generally downwardly into the burden and is distributed laterally, or horizontally, across the burden in a flow pattern indicated by the gas flow arrows 21, before flowing vertically upward in counterflow relationship to the descending burden 14. Reacted reducing gas exits from the burden at stockline 22 and is removed through reacted reducing gas offtake pipe 25. The lower part of the furnace converges toward a product discharge opening 30.

The furnace preferably includes an accumulation chamber 34 beneath the discharge opening, but a separate in-line accumulation hopper may be used. Chamber 34 acts as a hopper or feed bin for feeding the particulate direct reduced metallized product of shaft furnace 10 to briquetting rolls 38 and 40. The briquetting rolls may have mating recesses or pockets for forming "pillow shaped" briquets or they may have non-mating recesses or pockets for forming "D" shaped briquets. Briquetting machines which form "D" shaped briquets have a limited tonnage output. In order to have a maximum output, briquetting machines are employed which form "pillow shaped" briquets. Although briquet breaking machinery is currently available for breaking both "D" shaped briquets and "pillow shaped" briquets, the briquet sheet breaker of the present invention is not limited in its capacity and is therefore an improvement over all previously known briquet strip or sheet breakers. The hot briquet product is a sheet which must be broken to obtain the individual briquet. The briquet sheet product 44 is deflected by chute 46 onto carrying conveyor 48. Quenching sprays 50 cool the briquet sheet to at least 425° C., and preferably to the range of 250° C. to 350° C. As shown in FIG. 2, the conveyor 48 has curved (non-linear) cross-bars or slats 52. A conforming conveyor 60 has mating slats or cross-bars 62 (FIG. 3) which force the briquet sheet to assume the contour of the slats. As the briquet sheet is forced to assume the curved transverse configuration, the longitudinal web between rows of adjacent briquets is cracked or weakened. As the briquet sheet passes around the end of conveyor 48, the center line of each longitudinal row of briquets follows a different length path. The bending stress of the brittle transverse material breaks the web away from the briquets transversely and the difference in path length of each longitudinal row of briquets completes the breaking of the longitudinal web.

It has been determined experimentally that in order to separate or break individual briquets from adjacent briquets in a strip, it is necessary to bend the cooled strip at least 10 degrees and preferably about 15 degrees between adjacent briquets.

When a briquet sheet is so wide that the arcuate configuration of slats 52 will not bend the sheet at least 10° between briquets, the alternative configurations of FIGS. 3A or 3B can be utilized. FIG. 3A shows a waveform slat 64 on conveyor 48, and a mating slat 65 on conforming conveyor 60. Slat 67 in FIG. 3B has a saw-tooth cross section which mates with slat 68 of conforming conveyor 60. In the configuration of FIG. 3B, the distance between saw-tooth peaks and valleys is that of center to center of the webs between adjacent briquets.

Figure 5:
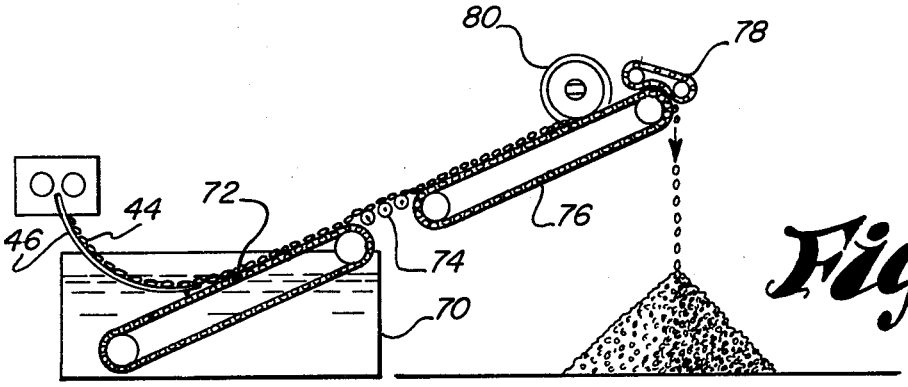
FIG. 5 is a schematic elevational view of a briquetting machine, briquet sheet quench tank and breaker apparatus.

In the alternative embodiment shown in FIG. 5, the briquet sheet 44 may enter quenching tank 70 then be removed by a conveyor 72 having a flat cross section. Idle conveyor rollers 74, or guides, lead the sheet into a conveyor 76 having slats with curved cross sections, prior to the sheet being contacted by a conforming conveyor 78. In addition, to remove some of the force requirements from the conforming conveyor, a conforming roll 80 may be positioned ahead of the conforming conveyor 78 to push the cold sheet 44 down against the slats of the carrying conveyor 76.

Figure 6:
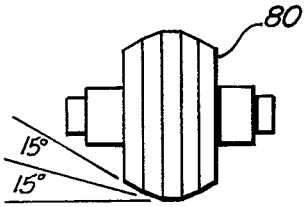
FIG. 6 shows the configuration of a conforming roll.

The conforming roll 80 as shown in FIG. 6 is designed for a five briquet width sheet. Note that each section of the roll face is angled 15 degrees from each adjacent face. A greater or lesser number of faces may be provided to allow for briquet sheets of various widths. A conforming roll could also be utilized with other slat configurations such as those in FIGS. 3A and 3B. If desired, each roll face could have a slight recess to accommodate the longitudinal strip of briquets. This would prevent the briquet strip from becoming misaligned with the carrying conveyor.

It should be noted that the arcuate carrying conveyor of FIG. 2 can be either concave or convex in cross section, but it is preferred to be concave to prevent the briquet sheet from sliding off the conveyor. Nonetheless with proper guides, the conveyor could be convex. This would probably necessitate the use of a concave conforming roll prior to the sheet being contacted by the conforming conveyor.

From the foregoing it is readily apparent that we have provided a method of producing individual briquets and an apparatus for breaking apart individual briquets which were produced in the form of a sheet or strip of connected briquets.

While a preferred and alternative embodiment of this invention are discussed and depicted in conformance with the patent statutes, it is clear that one skilled in the art could make certain modifications without departing from the scope of the invention as defined in the following claims.

What is claimed is:

1. A method for producing individual metallized iron briquets comprising:

reducing iron oxide feed material by continuous gaseous direct reduction in a shaft furnace to form a hot particulate metallized iron product:

compacting said metallized iron product by briquetting it to form a densified elongated sheet of briquets connected by both longitudinal and transverse webs;

cooling said sheet to a temperature less than 425 degrees C.;

bending said sheet transversely and bending said sheet longitudinally to break the connection between adjacent briquets in both directions thereby separating the sheet into individual briquets.

2. A method according to claim 1 wherein said sheet is forced to conform to the contours of two mating conveyors between which the sheet passes.

3. A method for separating a sheet of hot briquets connected by both longitudinal and transverse webs, comprising:

cooling said sheet to less than 425 degrees C.;

bending said sheet transversely at least 10 degrees between adjacent briquets; and bending said sheet longitudinally at least 10 degrees between adjacent briquets.

4. A method according to claim 3 further comprising bending adjacent longitudinal webs alternately up and down.

5. A method according to claim 3 wherein said briquet sheet is forced to conform to the contours of mating conveyors to separate said briquets.

* * * * *